US009570793B2

(12) United States Patent
Borodulin

(10) Patent No.: US 9,570,793 B2
(45) Date of Patent: Feb. 14, 2017

(54) DIRECTIONAL COUPLER SYSTEM

(71) Applicant: GATESAIR, INC., Mason, OH (US)

(72) Inventor: Dmitri Borodulin, South Lebanon, OH (US)

(73) Assignee: Gatesair, Inc., Mason, OH (US)

( * ) Notice: Subject to any disclaimer, the term of this patent is extended or adjusted under 35 U.S.C. 154(b) by 220 days.

(21) Appl. No.: 14/253,533

(22) Filed: Apr. 15, 2014

(65) Prior Publication Data

US 2015/0293304 A1 Oct. 15, 2015

(51) Int. Cl.
*H01P 5/18* (2006.01)
*H01P 3/08* (2006.01)

(52) U.S. Cl.
CPC ..... *H01P 5/185* (2013.01)

(58) Field of Classification Search
CPC ..... H01P 5/18; H01P 5/184
USPC ..... 333/109–112, 116
See application file for complete search history.

(56) References Cited

U.S. PATENT DOCUMENTS 3,423,675 A * 1/1969 Richter ..... G01R 27/02 324/629
3,737,810 A * 6/1973 Shelton ..... H01P 5/187 333/116
3,737,820 A * 6/1973 Harris ..... H01H 43/125 335/65
3,904,991 A * 9/1975 Ishii ..... H01P 5/185 333/116
3,979,699 A * 9/1976 Caragliano ..... H04B 3/02 333/116
6,208,220 B1 * 3/2001 Logothetis ..... H01P 5/187 333/116
7,187,910 B2 * 3/2007 Kim ..... H01P 5/185 333/109
7,190,240 B2 3/2007 Podell
7,345,557 B2 * 3/2008 Podell ..... H01P 5/187 333/109
2007/0159268 A1 7/2007 Podell
2009/0128255 A1 * 5/2009 Dupont ..... H01P 5/18 333/109
2012/0194293 A1 8/2012 Dupont et al.
(Continued)

FOREIGN PATENT DOCUMENTS

CN 201282181 Y 7/2009
DE 3741284 A1 12/1987
(Continued)

OTHER PUBLICATIONS

Chris McCormick, "Microstrip Couplers"; Paper, San Jose State University—College of Engineering, Electrical Engineering Department EE 172, Dr. Ray Kwok, Dec. 17, 2012, 19 pgs.
(Continued)

*Primary Examiner* — Dean Takaoka
(74) *Attorney, Agent, or Firm* — Tarolli, Sundheim, Covell & Tummino LLP

(57) ABSTRACT

A circuit can include a tandem directional coupler comprising a first directional coupler and a second directional coupler connected in tandem. Each of the first and second directional couplers can have a first strip and a second strip. Port 3 of the first directional coupler can be connected to Port 1 of the second directional coupler. Port 4 of the first directional coupler can be connected to Port 2 of the second directional coupler.

17 Claims, 8 Drawing Sheets

(56) References Cited

U.S. PATENT DOCUMENTS

2012/0229229 A1* 9/2012 Franzon ..... H01P 1/213
333/110

FOREIGN PATENT DOCUMENTS

| | | | |
|---|---|---|---|
| EP | 0798922 | B1 | 9/2002 |
| EP | 1306692 | B1 | 3/2006 |
| JP | 2861228 | B2 | 12/1998 |

OTHER PUBLICATIONS

David Norte, PhD, "Even and Odd Mode Signal Propagation Microstriplines", www.the-signal_and_power_integrity_institute.com, Publication, for Coplanar Coupled Copyright 2011; pp. 1-4.

J.W. Gipprich, "A New Class of Branch-Line Directional Couplers", IEEE MTT-S Digest, Copyright 1993, pp. 589-592.

Pertti K. Ikäläinen, et al., "Wide-Band, Forward-Coupling Microstrip Hybrids With High Directivity", IEEE Transactions on Microwave Theory and Techniques, vol. MTT-35, No. 8 Aug. 1987, pp. 719-725.

Jeong-Hoon Cho, et al., "A Design of Wideband 3-dB Coupler with N-Section Microstrip Tandem Structure", IEEE Microwave and Wireless Components Letters, vol. 15, No. 2, Feb. 2005, pp. 113-115.

Thomas Sieverding, et al., "Modal Analysis of Parallel and Crossed Rectangular Waveguide Broadwall Couplers With Apertures of Aribtrary Shape", IEEE MTT-S Digest, Jun. 1997; pp. 1559-1562.

D.-Z. Chen, et al., "Compact Microstrip Parallel Coupler With High Isolation", Publication, Electronics Letters, Vol. 44, No. 12, Jun. 5, 2008, 2 PP.

International Search Report and Written Opinion dated Jun. 30, 2015.

Moon et al. "V-Band CPW 3-dB Tandem Coupler Using Air-Bridge Structure", IEE Microwave and Wireless Components Letters, vol. 16, No. 4, Apr. 2006.

* cited by examiner

DIRECTIONAL COUPLER SYSTEM

TECHNICAL FIELD

This invention relates to a tandem directional coupler.

BACKGROUND

Directional couplers have many applications. A microstrip directional coupler is a 4-port radio frequency (RF) device based on a printed circuit board with two copper plated sides. Copper plating on the bottom side of the board is intact and serves as ground return path for all 4 ports of the microstrip directional coupler. The copper plating on the top side of the board is formed into two parallel traces. The advantage of microstrip line technology is simplicity and high repeatability. A typical microstrip line based directional coupler utilizes edge electromagnetic (EM) coupling between two copper traces. The width of the traces determines the characteristic impedance of the traces. The length of the traces determines the frequency of operation. The distance between traces determines the coupling factor. The closer the traces to each other the tighter is the coupling between them. Loosely coupled microstrip directional couplers are used to monitor incident and reflected RF signal flow. Other applications include retrieving a sample of incident RF signal for automatic gain/power control at the output of the RF transmitter. Reflected RF signal sample can be used to estimate a voltage standing wave ratio (VSWR) of the antenna feed and used to protect RF transmitter from inadvertent device failure when reflected signal is too high.

SUMMARY

One example relates to a circuit including a tandem directional coupler that can include a first directional coupler and a second directional coupler connected in tandem. Port 3 of the first directional coupler can be connected to Port 1 of the second directional coupler and Port 4 of the first directional coupler can be connected to Port 2 of the second directional coupler.

Another example relates to a system for monitoring incident signal at Port 1 of a tandem directional coupler. The system can include the tandem directional coupler that can include a first relatively tightly coupled directional coupler and a second relatively tightly coupled directional coupler connected in tandem. Port 3 of the first directional coupler can be connected to Port 1 of the second directional coupler and Port 4 of the first directional coupler can be connected to Port 2 of the second directional coupler. The system can also include an RF signal source configured to provide an incident signal to Port 1 of the first directional coupler. The system can further include a load with a predefined impedance connected to Port 2 of the first directional coupler. The load can be matched to receive the output signal that corresponds to the incident signal. The system can further include a signal monitoring device connected to one of the Port 3 or Port 4 of the second tightly coupled directional coupler. The signal monitoring device can be configured to monitor one of the incident signal and a reflected signal.

Yet another example relates to a tandem directional coupler that can include a first microstrip line directional coupler that can include a first copper trace and a second copper trace parallel to the first copper trace. The tandem directional coupler can also include a second microstrip line directional coupler that can include a first copper trace and a second copper trace parallel to the first copper trace. Port 3 of the first directional coupler can be connected to Port 1 of the second directional coupler. Additionally, Port 4 of the first directional coupler can be connected to Port 2 of the second directional coupler.

DETAILED DESCRIPTION

A system for monitoring incident and reflected radio frequency (RF) signals can include a directional coupler. The directional coupler can include a tandem connection of first and second microstrip directional couplers. Each of the first and second microstrip directional couplers of the tandem connection can be relatively tightly coupled. In this way, Ports 3 and 4 of the newly formed tandem directional coupler can be relatively loosely coupled with Ports 1 and 2 (e.g., a thru port) of the first microstrip directional coupler. The newly formed tandem directional coupler retains directivity level of the included directional couplers while achieving a new loose coupling coefficient.

Figure 1:
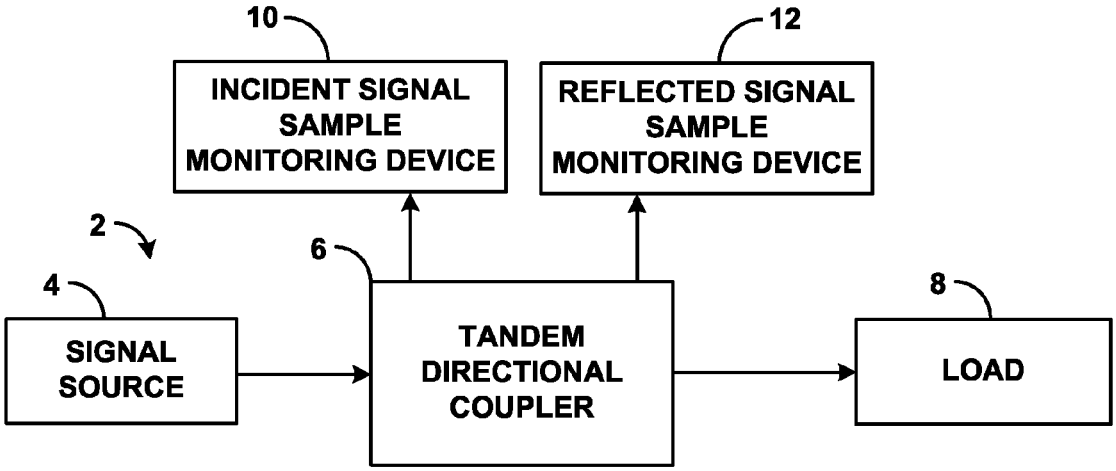
FIG. 1 illustrates an example of a system for monitoring an incident RF signal.

FIG. 1 illustrates an example of a system 2 for monitoring incident and reflected RF signals. The system 2 can include a RF signal source 4 that can provide an input RF signal to the directional coupler. The input signal can be provided to a tandem directional coupler 6. The tandem directional coupler 6 can be configured as a circuit that includes two directional couplers connected in tandem. The tandem directional coupler 6 can be configured to couple a relatively small percentage of the input signal (e.g., about 5% of power level or less) to deliver to an incident signal sample monitoring device 10 and provide the remaining percentage (e.g., 95% or more) of the input signal to the load 8. The portion of the signal coupled to the signal monitoring device 10 can be referred to as an incident signal sample. The load 8 could be implemented, for example, as a resistive and/or a reactive load, such as a transmission line and/or an antenna.

In some examples, the incident signal sample monitoring device 10 could be employed to measure the power of the RF signal delivered to the load 8 by measuring the level of the signal sample.

Each of two couplers can be designed as a relatively tightly coupled microstrip directional coupler. As explained herein, connecting the plurality of couplers in tandem to provide the tandem directional coupler 6 maintains the directivity of a relatively tightly coupled coupler, while providing loose coupling to provide a sample (e.g., a small percentage) of the high power signal suitable for monitoring.

Additionally, the system 2 can include a reflected signal sample monitoring device 12 coupled to the tandem directional coupler. The tandem directional coupler 6 can be configured such that a relatively small percentage of the signal reflected by load 8 (e.g., about 5% of power level or less) is delivered to the reflected signal sample monitoring device 12, so as to facilitate monitoring of an amount of power reflected from the load 8.

Figure 2:
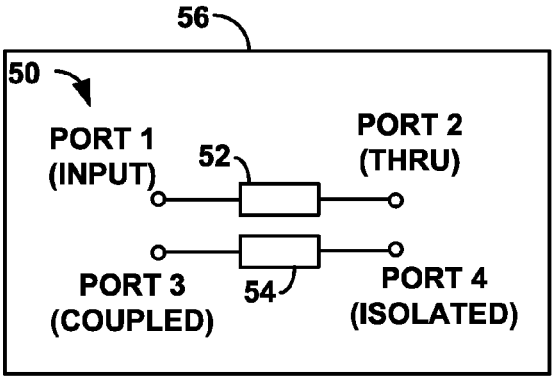
FIG. 2 illustrates an example of port assignment of a directional coupler.

FIG. 2 illustrates an example of a (single) coupler 50 that could be employed as an element of the directional coupler system 6 illustrated in FIG. 1. The coupler 50 can be a microstrip coupler, such as a relatively tightly coupled microstrip directional coupler. In such a situation, the coupler 50 can be formed as a first copper trace 52 (e.g., a first strip) that is etched parallel to a second copper trace (e.g., a second strip) 54 on a substrate 56, such as a printed circuit board (PCB). The coupler 50 can include four different ports. A first port ("Port 1"), which can be an input port (labeled in FIG. 2 as "PORT 1 (INPUT)") can be configured to receive an input RF signal in examples where the coupler 50 is implemented as a directional coupler. The coupler 50 can include a second port ("Port 2"), which can be a thru port (labeled in FIG. 2 as "PORT 2 (THRU)"). The coupler 50 can also include a third port ("Port 3"), which can be a coupled port (labeled in FIG. 2 as "PORT 3 (COUPLED)"). Additionally, the coupler 50 can include a fourth port ("Port 4") that can be an isolated port (labeled in FIG. 2 as "PORT 4 (ISOLATED)"). Typically, Port 4 provides a relatively small output signal that is dependent on the directivity level of the directional coupler.

A transmission coefficient, $\tau$ of the coupler 50 can be determined by employing Equation 1, while a coupling factor, k, for the coupler 50 can be determined by employing Equation 2.

$$\tau = \frac{\sqrt{1-c^2}}{\sqrt{1-c^2}\cos\left(\frac{2\pi f}{v_p}(L)\right) + j\sin\left(\frac{2\pi f}{v_p}(L)\right)} \quad \text{Equation 1}$$

$$k = \frac{jc\sin\left(\frac{2\pi f}{v_p}(L)\right)}{\sqrt{1-c^2}\cos\left(\frac{2\pi f}{v_p}(L)\right) + j\sin\left(\frac{2\pi f}{v_p}(L)\right)} \quad \text{Equation 2}$$

wherein:

$\tau$ is a transmission coefficient of the coupler 50, and the transmission coefficient characterizes a voltage of a transmitted wave relative to an incident wave;

k is a coupling factor of the coupler 50 and k can correspond to a voltage that is provided at Port 3;

c is a coupling coefficient of the coupler 50 at the center frequency of the coupler 50, and c is a real number;

f is a frequency, in hertz (Hz) of the input signal;

$v_p$ is a propagation velocity of a medium containing the coupler 50, in meters per second. For air, this value can be estimated to be about $300\times10^6$ meters per second; and L is the length of the coupler 50, in meters.

As noted, the coupler 50 can be a microstrip coupler that is formed of the first copper trace 52 (e.g., the first strip) and the second copper trace 54 (e.g., the second strip) etched on to the substrate 56 (e.g., a PCB). In such a situation, the coupler 50 can be an in-homogenous coupler 50 since the electromagnetic (EM) field generated by the signal propagating through the copper traces exists both inside the dielectric substrate and outside. The dielectric constant of air (over the substrate 56) is different from the dielectric constant of the substrate 56. Accordingly, propagation velocities of the EM wave in the air is higher than propagation velocity of the wave in the dielectric substrate. This can result in relatively poor directivity, which can worsen with reduction of coupling coefficient value. For instance, even a 10% difference in phase velocities can reduce directivity of the coupler 50 with a coupling coefficient, c of −10 dB, −15 dB and −20 dB to about 13 dB, 8 dB and 2 dB, respectively from a theoretical value (infinite value) with equal-phase velocities. Accordingly, the deterioration in directivity of the coupler 50 is higher for larger propagation velocity differences.

Figure 3:
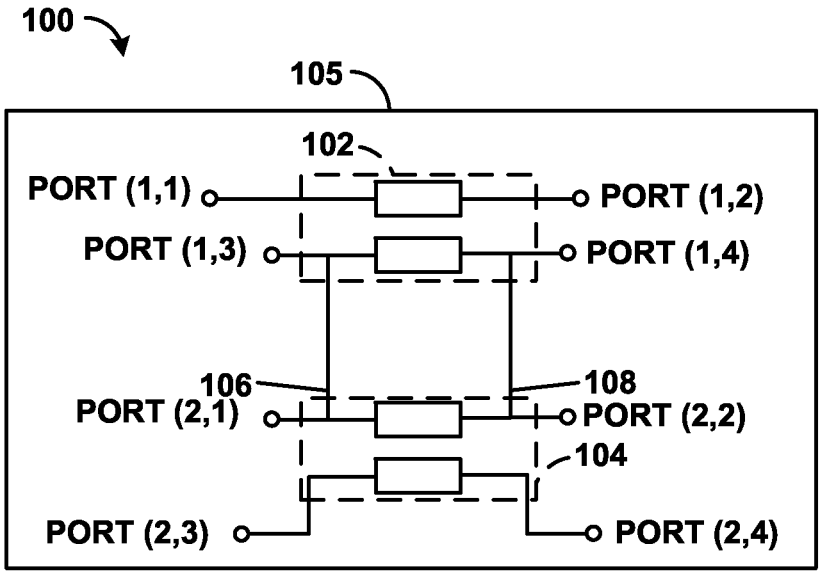
FIG. 3 illustrates a proposed tandem connection between two directional couplers to form a new directional coupler.

FIG. 3 illustrates an example of a tandem directional coupler 100 that could be employed to implement the tandem directional coupler 6 illustrated in FIG. 1. The tandem directional coupler 100 can be formed by connecting a first directional coupler 102 and a second directional coupler 104 in tandem, which can be referred to as a "tandem connection". Each of the first directional coupler 102 and the second directional coupler 104 can be implemented as the coupler 50 illustrated in FIG. 2. Accordingly, each of the first directional coupler 102 and the second directional coupler 104 can include four ports. For purposes of simplification of explanation, each port on the directional coupler system 6 is labeled with a two-dimensional number, wherein the first number indicates the coupler number and the second number indicates the port number. For instance, Port (1,1) (labeled in FIG. 3 as "PORT (1,1)") corresponds to the Port 1 (a first port) on the first directional coupler 102. Similarly, Port (2,3) (labeled in FIG. 3 as "PORT (2,3)") corresponds to Port 3 (a third port) on the second directional coupler 104.

As noted, the first and second coupler 102 and 104 can be connected in tandem. Specifically, Port (1,3) can be connected via a conductive trace, which can be referred to as a "coupling trace" 106 to Port (2,1). Similarly, Port (1,4) can be connected to Port (2,2) through another coupling trace 108. The coupling traces 106 and 108 can be the same length (or nearly the same length).

In some examples, both the first directional coupler 102 and the second directional coupler 104 can be implemented with the same (or nearly the same) coupling characteristics (e.g., the same or nearly the same physical characteristics). In other examples, the first directional coupler 102 and the second directional coupler 104 can be implemented with different coupling characteristics. As noted with respect to FIG. 1, Equations 1 and 2 can be employed to calculate the transmission coefficient $\tau$ and the coupling factor k for each of the first directional coupler 102 and the second directional coupler 104. The coupling factor for the first directional coupler 102 can be labeled as k' and the transmission coefficient can be labeled as τ'. Similarly, the coupling factors for the second directional coupler 104 can be labeled as k" and the transmission coefficient for the second directional coupler 102 can be labeled as τ".

In some examples, an Port (1,1) can be implemented as an input port and Port (1,2) can be an output port. Moreover, as explained herein, Port (2,3) can be an incident power sample port and Port (2,4) can be a reflected power sample port.

If two identical directional couplers (or nearly identical directional couplers) are used to build the tandem directional coupler 100 even and odd mode analysis can be used to verify an input impedance at Port 1.

Figure 4:
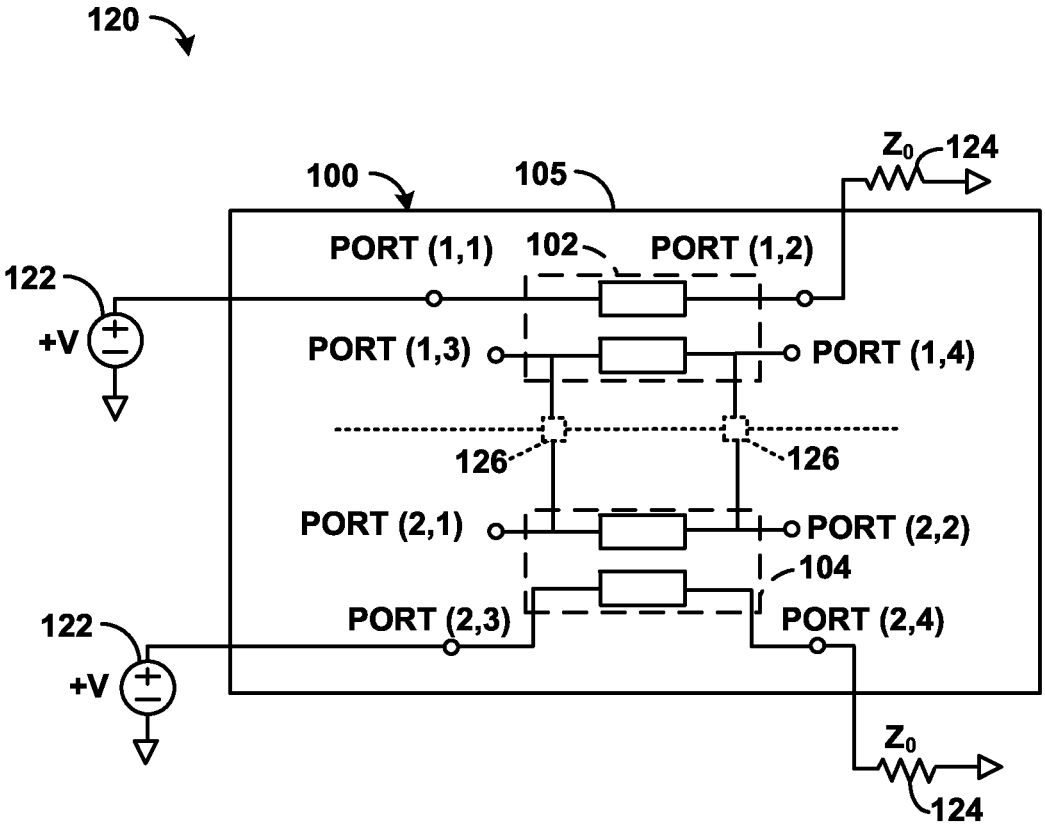
FIG. 4 illustrates an example of the proposed tandem directional coupler illustrated in FIG. 3 operating in even mode of excitation.
Figure 5:
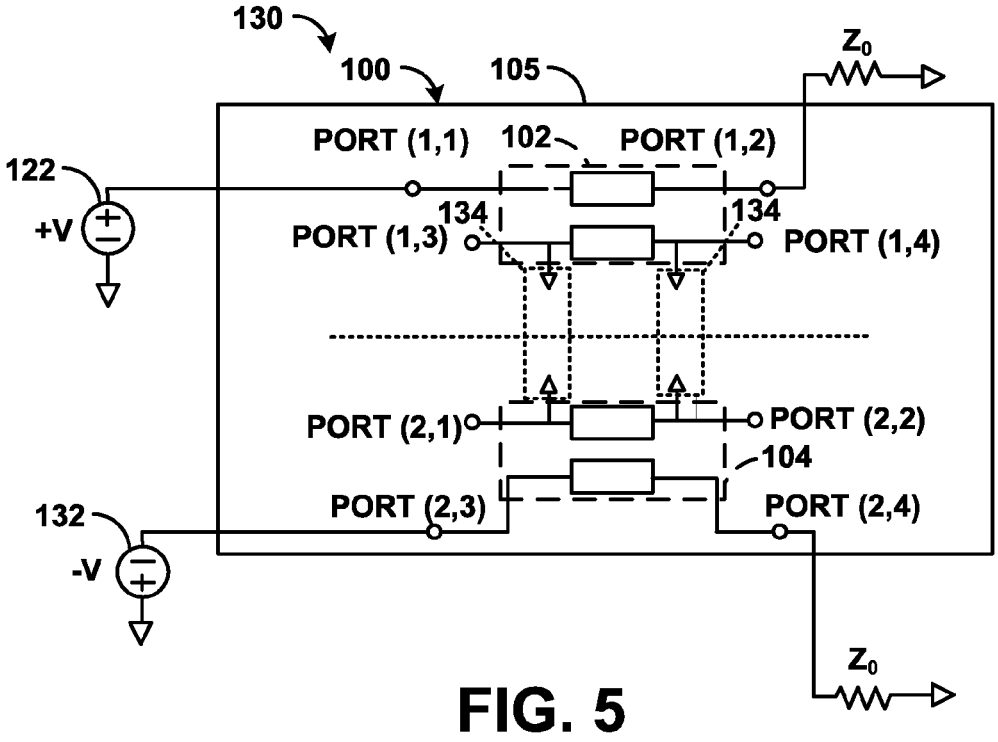
FIG. 5 illustrates an example of the proposed tandem directional coupler illustrated in FIG. 3 operating in odd mode of excitation.

FIG. 4 illustrates a decomposition of the above mentioned tandem directional coupler 100 excited with two similar signal sources. The arrangement in FIG. 4 provides conditions for even mode analysis. FIG. 5 illustrates decomposition of the tandem directional coupler 100 excited with two voltage sources of equal voltage and opposite polarity into two identical couplers with corresponding ports terminated to a ground terminal. The arrangement in FIG. 5 provides conditions for the odd mode analysis. FIGS. 3-5 employ the same reference numbers to denote the same structure.

In the even mode of excitation the directional coupler 102, Port (1,1) and Port (2,3) are individually coupled to separate voltage sources 122 that provide a positive voltage, +V. Moreover, Port (1,2) and Port (2,4) of the even mode directional coupler system 120 can be connected to a resistor with an impedance of $Z_0$ (e.g., 50 Ohms). Due to symmetry during even mode operation, the current between Port (1,3) and Port (2,1) (through coupling trace 106) and the current between Port (1,4) and (2,2) (through coupling trace 108) does not exist. Therefore, both connections operate as an open circuit 126.

The odd mode excitation within tandem directional coupler 130 is organized the same as the even mode directional coupler system 120, except that a voltage source 132 provides a voltage, −V that is equal in magnitude but opposite in polarity to +V. During odd mode operation, the voltage potential at the connection point between Port (1,3) and Port (2,1) (coupling trace 106) is equal to zero volts. The connection between Port (1,4) and (2,2) (coupling trace 108) also has a voltage potential of zero volts, such that both operate as a short circuit connection to ground 134.

Figure 6:
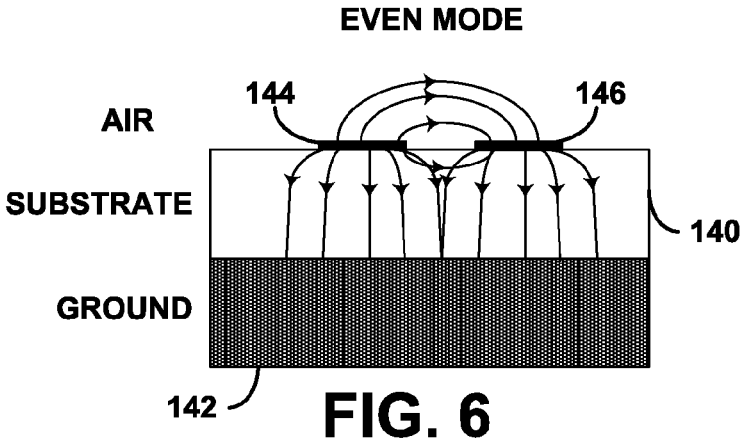
FIG. 6 illustrates an example of electric field distribution in even mode of excitation illustrated in FIG. 4.
Figure 7:
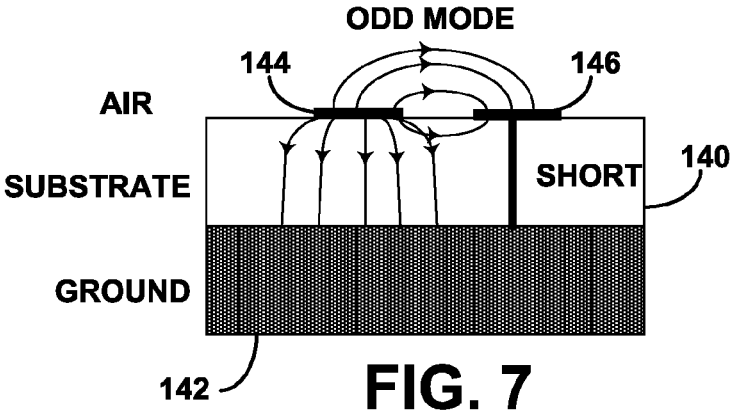
FIG. 7 illustrates an example of electric field distribution in odd mode of excitation illustrated in FIG. 5.

FIG. 6 illustrates a diagram of an electrical field of the positive charge imposed by input voltage source +V during even mode excitation. FIG. 7 illustrates a diagram of an electrical field of a positive charge supplied by the input signal source with voltage of +V during the odd mode of excitation. For purposes of simplification of explanation, FIGS. 6 and 7 employ the same reference numbers to denote the same structure. In FIGS. 6 and 7, dielectric substrate 140 (labeled in FIGS. 6 and 7 as "SUBSTRATE") overlays a ground plane 142 (labeled in FIGS. 6 and 7 as "GROUND"). Moreover, air (labeled in FIGS. 6 and 7 as "AIR") overlays the dielectric substrate 140. The substrate 140 has a first copper trace 144 and a second copper trace 146 that are parallel to each other. The first copper trace 144 forms a microstrip line that connects Port (1,1) and Port (1,2) of FIGS. 4 and 5. Additionally, the second copper trace 146 forms a second microstrip line that connects Port (1,3) and Port (1,4) of FIGS. 4 and 5.

A conventional (single) microstrip coupler has an electric field for the even mode concentrated mostly inside of a substrate (e.g., a dielectric substrate) and an electric field for the odd mode that is split between the air and dielectric, thereby resulting in an inhomogeneous field distribution and difference in propagation velocities in each mode.

As illustrated in FIGS. 6 and 7, in a tandem connection, the electrical field distribution for the even mode and the odd mode is more close to being homogeneous for those two modes due to the fact that even mode electrical field contains a portion of the field in the air, providing conditions for the same (or close) propagation velocities. As illustrated in FIGS. 6 and 7, the electrical field traversing the air is similar in both the even mode and the odd mode of operation.

Referring back to FIGS. 3-5, even and odd mode wave impedances of the tandem directional coupler 100 can be derived by analysis of impedances of the first directional coupler 102 and the second directional coupler 104, which are each conventional microstrip couplers. Specifically, an equivalent even mode characteristic impedance, $Z_{ee}$ of the tandem directional coupler 100 can be calculated with Equation 3.

$$Z_{ee} = \frac{Z_{0e} + Z_{0o}}{2} \qquad \text{Equation 3}$$

wherein:

$Z_{0e}$ is the even mode characteristic impedance of each of the first directional coupler 102 and the second directional coupler 104;

$Z_{0o}$ is the odd mode characteristic impedance of the first directional coupler 102 and the second directional coupler 104.

Further still, an equivalent odd mode characteristic impedance, $Z_{eo}$ for the tandem directional coupler can be derived with Equation 4.

$$Z_{eo} = 2\frac{Z_{oe}Z_{0o}}{Z_{0e} + Z_{0o}} \qquad \text{Equation 4}$$

Equation 5 can be employed to define the characteristic impedance, $Z_{e0}$ of the tandem directional coupler 100.

$$Z_{e0}=\sqrt{Z_{ee}Z_{eo}}=\sqrt{Z_{0e}Z_{0o}}=Z_0 \qquad \text{Equation 5:}$$

As characterized in Equation 5, the equivalent characteristic impedance, $Z_{e0}$ of each of the couplers included in the tandem directional coupler 100 is equal to the characteristic impedance, $Z_0$ of a conventional microstrip directional coupler (the first directional coupler 102 and the second directional coupler 104). However, a homogeneous propagation environment of the tandem directional coupler 100 (with a tandem connection between the first directional coupler 102 and the second directional coupler 104) facilitates propagation velocities of RF signals in even and odd mode of excitation equal (or substantially equivalent to each other). Such homogenous propagation velocities can provide a significant improvement of input return loss over a wide frequency range.

Figure 8:
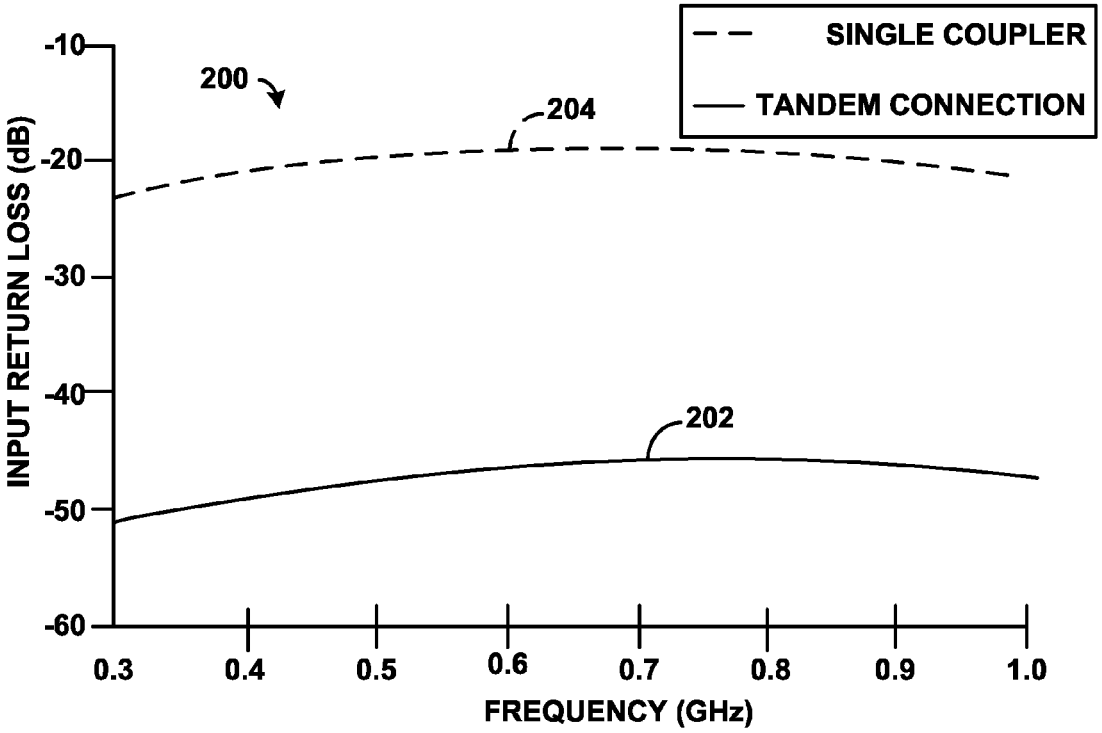
FIG. 8 illustrates a graph that plots an input return loss as a function of frequency.

FIG. 8 illustrates a graph 200 that plots an input return loss, in decibels (dB) plotted as a function of frequency of an input signal, in gigahertz (GHz). The graph 200 includes a first plot 202 that plots the input return loss for the tandem directional coupler 100, with a tandem connection between the first directional coupler 102 and the second directional coupler 104. The graph 200 also includes a second plot 204 that plots the input return loss for a single, conventional directional coupler, such as the coupler 50 illustrated in FIG. 2. As is illustrated by the graph 200, the input return loss of the tandem directional coupler 100 is about 26 dB better than the input return loss on a single conventional directional coupler.

Figure 9:
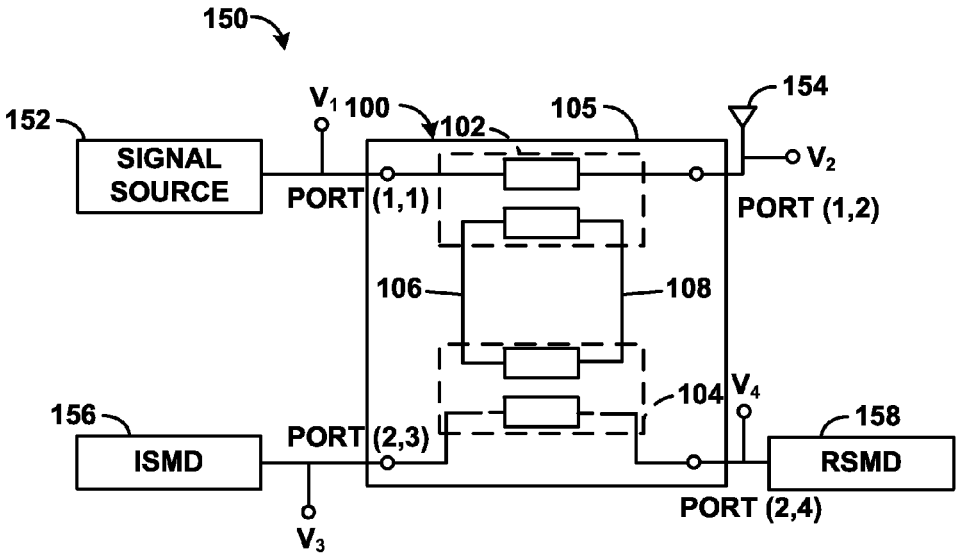
FIG. 9 illustrates a voltage assignment to the ports of the proposed tandem directional coupler illustrated in FIG. 3.

FIG. 9 illustrates an example of a system 150 that employs the tandem directional coupler 100 illustrated in FIG. 3. For purposes of simplification of explanation, the same reference numbers are employed in FIGS. 3 and 9 to denote the same structure. The system 150 can include an RF signal source 152 coupled to Port (1,1) that can provide an input signal. Additionally, Port (1,2) can be coupled to an antenna 154 (or other load, such as a transmission line terminated to an antenna). In some examples, the antenna 154 can have an impedance of about 50 Ohms. Port (2,3) and Port (2,4) can be coupled to (e.g., terminated at) an input of incident signal monitoring device 156 (labeled in FIG. 4 as "ISMD") that can also have an input impedance $Z_0$, such as an impedance of 50 Ohms. A reflected signal monitoring device 158 (labeled in FIG. 4 as "RSMD") can be coupled to Port (2,4) of the tandem directional coupler 100.

In the system 150 illustrated in FIG. 9, certain features, such as the signal source 152, the antenna 154, the output signal monitoring device 156, the reflected signal monitoring device 158 are illustrated as being external to the PCB 105. However, in other examples, some or all of these components can be situated on the PCB 105.

The voltage at Port (1,1) can be referred to as $V_1$ (labeled in FIG. 9 as "$V_1$"). The voltage at Port (1,1) can be referred to as $V_2$ (labeled in FIG. 9 as "$V_2$"). The voltage at Port (2,3) can be referred to as $V_3$ (labeled in FIG. 9 as "$V_3$"). The voltage at Port (2,4) can be referred to as $V_4$ (labeled in FIG. 9 as "$V_4$"). Equation 6 can be employed to determine a voltage ratio between $V_1$ and $V_3$.

$$\frac{V_3}{V_1} = \frac{k' + \tau'\Gamma_l I'}{1 - \tau'\tau''}k'' + \frac{I' + \tau''\Gamma_l}{1 - \tau'\tau''}I'' \qquad \text{Equation 6}$$

wherein:

k' is the coupling factor of the first directional coupler 102 of the system 150;

k" is the coupling factor of the second directional coupler 104 of the system 150;

τ' is the transmission coefficient of the first directional coupler 102 of the system 150;

τ" is the transmission coefficient of the second directional coupler 102 of the system 150;

I' is the isolation coefficient of the first directional coupler 102 of the system 150;

I" is the isolation coefficient of the second directional coupler 104 of the system 150; and $\Gamma_l$ is the reflection coefficient at Port (1,2) (an output port) of the system 150.

The reflection coefficient, $\Gamma_l$ at Port (1,2) (the output port) can be about '0' if the impedance at Port (1,2) (e.g., the impedance of the antenna 154) is equal $Z_0$. In such a situation, Equation 6 can be simplified into Equation 7.

$$\frac{V_3}{V_1} = S_{3,1} = \frac{k'k''}{1 - \tau'\tau''} + \frac{I'I''}{1 - \tau'\tau''} \qquad \text{Equation 7}$$

Furthermore, if both the first directional coupler 102 and the second directional coupler 104 have the same (or similar) coupler characteristics, Equation 7 can be further simplified by employing properties defined in Equations 8-10.

$$k' = k'' = k \qquad \text{Equation 8:}$$

$$\tau' = \tau'' = \tau \qquad \text{Equation 9:}$$

$$I' = I'' = I \qquad \text{Equation 10:}$$

Specifically, by substituting Equations 8-10 into Equation 7, Equation 13 can be derived.

$$\frac{V_3}{V_1} = S_{3,1} = \frac{k^2}{1 - \tau^2} + \frac{I^2}{1 - \tau^2} \qquad \text{Equation 13}$$

wherein τ and k are defined by Equations 1 and 2, respectively; and $S_{3,1}$ is a coupling coefficient between Port (1,1) of the tandem directional coupler 100 and Port (2,3) of the tandem directional coupler 100.

The coupling coefficient of the system 150 at a center frequency can be calculated by substituting L=λ/4 into Equation 2, which produces a result of k=c. Moreover, Equation 14 can be employed to determine the transmission coefficient, τ for the system 150 at the center frequency.

$$\tau = \frac{\sqrt{1 - c^2}}{j} = -j\sqrt{1 - c^2} \qquad \text{Equation 14}$$

By substituting Equation 14 into Equation 7, Equation 7 can be further simplified into Equation 15.

$$\frac{V_3}{V_1} = S_{3,1} \sim \frac{c^2}{1 - \left(-j\sqrt{1 - c^2}\right)^2} = \frac{c^2}{1 + (1 - c^2)} = \frac{c^2}{2 - c^2} \qquad \text{Equation 15}$$

For instance if the coupling coefficient, c, is about −10 dB for each of the first directional coupler 102 and the second directional coupler, then $$\frac{V_3}{V_1} = S_{3,1} \sim -25.6 \text{ dB.}$$

Figure 10:
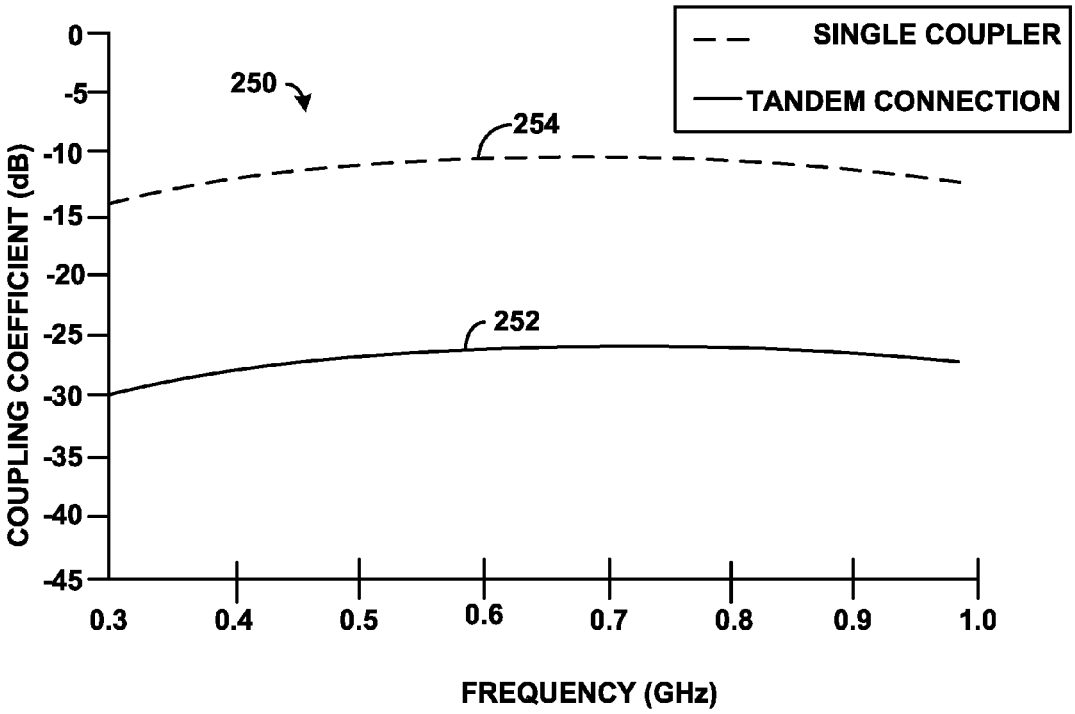
FIG. 10 illustrates an example of a graph that plots a coupling coefficient as a function of frequency.

FIG. 10 illustrates an example of a graph 250 that plots a coupling coefficient (in dB) as a function of frequency (in GHz). The graph 250 includes a first plot 252 that plots the coupling coefficient, k for the tandem directional coupler 100 that includes first directional coupler 102 and the second directional coupler 104 that each have a coupling coefficient of about −10 dB at a center frequency (e.g., about 0.7 GHz). The graph 250 also includes a second plot 254 that plots the coupling coefficient, k of a single, conventional directional coupler, such as the coupler 50 illustrated in FIG. 2. As is illustrated by the graph 250, connecting two −10 dB directional couplers (e.g., the first directional coupler 102 and the second directional coupler 104) in the tandem will form a new directional coupler (e.g., the tandem directional coupler 100) with a coupling coefficient of about −25.6 dB.

As is illustrated by the graph 250, a resulting coupling coefficient of the tandem coupler (tandem directional coupler 100 of the system 150) is $2-c^2$=5.6 dB higher than two directional couplers with a coupling coefficient of about −10 dB connected in a different manner (e.g., in series). Therefore, the tandem connection between the first directional coupler 102 and the second directional coupler 104 provides an additional reduction of approximately 6 dB in the coupling coefficient when loose coupling is desired. Moreover, as illustrated by the plot 252, the 6 dB difference between initial coupling coefficient and the achieved coupling coefficient holds across a wide frequency range.

Referring back to FIG. 9, Equation 16 can be employed to determine a voltage ratio between $V_4$ and $V_1$ of the system 150, which voltage ratio can be referred to as an S-parameter, $S_{4,1}$ of the system 150.

$$\frac{V_4}{V_1} = S_{4,1} = \frac{k'l''}{1-\tau'\tau''} + \frac{l'k''}{1-\tau'\tau''} \quad \text{Equation 16}$$

Moreover, in examples where the first directional coupler 102 and the second directional coupler 104 have similar (or substantially identical) operational characteristics, Equations 8-10 can be substituted into Equation 16 to simplify Equation 16 into Equation 17.

$$\frac{V_4}{V_1} = S_{4,1} = \frac{2kl}{1-\tau^2} \quad \text{Equation 17}$$

Furthermore, by evaluating Equation 17 at a center frequency $$\left(L = \frac{\lambda}{4}\right),$$

Equation 17 can be further simplified into Equation 18.

$$\frac{V_4}{V_1} = S_{4,1} \sim \frac{2cl}{2-c^2} \quad \text{Equation 18}$$

A directivity, $D_{3,4}$ for the tandem directional coupler 100 that includes the first directional coupler 102 and the second directional coupler 104 connected in tandem can be determined by employing equation 19.

$$D_{3,4} = 20 \cdot \log\left(\frac{V_4}{V_3}\right) = 20 \cdot \log\left(\frac{2l}{c}\right) \quad \text{Equation 19}$$

Figure 11:
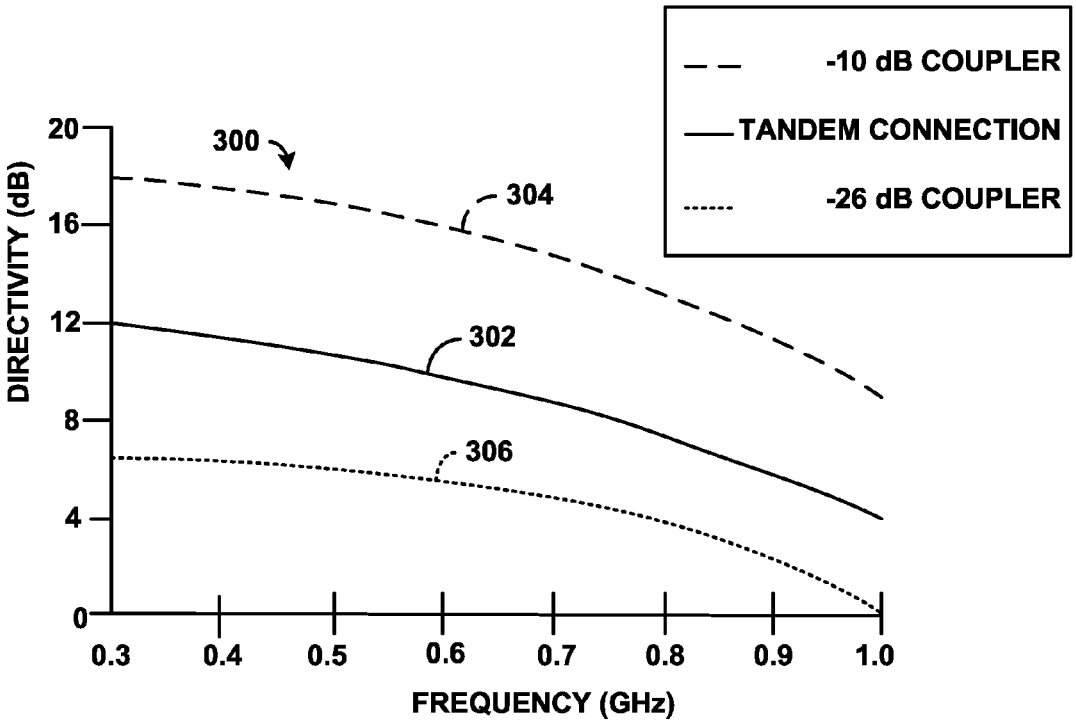
FIG. 11 illustrates an example of a graph that plots a directivity as a function of frequency.

FIG. 11 illustrates an example of a graph 300 that plots a directivity (in dB) as a function of frequency (in GHz). The graph 300 includes a first plot 302 that plots the directivity, $D_{3,4}$ for the directional coupler system 150, with a tandem connection between the first directional coupler 102 and the second directional coupler 104 (each with a center frequency (e.g., about 0.7 GHz) coupling coefficient of about −10 dB). The graph 300 also includes a second plot 304 that plots the directivity for a single conventional directional coupler such as the coupler 50 illustrated in FIG. 2, wherein the directional coupler has a coupling coefficient at a center frequency of about −10 dB. The graph 300 also includes a third plot 306 that plots the directivity for a single conventional directional coupler such as the coupler 50 illustrated in FIG. 2, wherein the directional coupler has a coupling coefficient at the center frequency of about −26 dB. As is illustrated by the graph 300, connecting two −10 dB directional couplers (e.g., the first directional coupler 102 and the second directional coupler 104) in the tandem connection provides an improved directivity over a directional coupler with a coupling coefficient (at the center frequency) of about −26 dB.

Referring back to FIG. 9, as illustrated in FIGS. 10 and 11, a relatively loose coupling can be achieved by connecting two tightly coupled directional couplers 102 and 104 in the manner shown (e.g., a connection between Ports (1,3) and (2,1) as well as a connection between Ports (1,4) and (2,2) made with coupling traces 106 and 108). The coupling traces 106 and 108 can have a finite length that can define a frequency response for the system 150. Stated differently, the frequency response of the tandem directional coupler 100 is not typically limited by the first directional coupler 102 and/or or the second directional coupler 104, but is also affected by the length of the coupling traces 106 and 108.

Moreover, by arranging the directional coupler system 150 in the tandem manner illustrated in FIG. 9 allows improvement of directivity relative to conventional single microstrip directional coupler with the same coupling coefficient. By connecting two relatively tightly coupled microstrip couplers 102 and 104 in tandem in the manner illustrated FIG. 9, a loose coupling for the tandem directional coupler 100 can still be realized, while retaining the higher directivity of a coupler with a tighter coupling factor.

Figure 12:
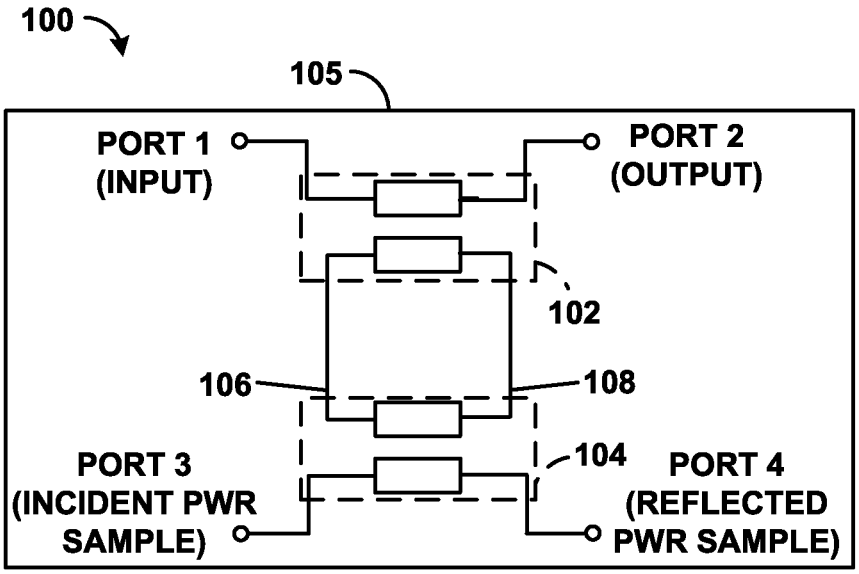
FIG. 12 illustrates an alternate port assignment to the proposed tandem directional coupler illustrated in FIG. 3.

FIG. 12 illustrates an example of the tandem directional coupler 100 illustrated in FIG. 3, wherein the ports have been reassigned (e.g., relabeled) for purposes of simplification of explanation. Moreover, the same references numbers are employed in FIGS. 3 and 12 to denote the same structure. In particular, the tandem directional coupler 100 includes four ports, namely Ports 1-4. Port 1 (labeled in FIG. 12 as "PORT 1 (INPUT)") of the tandem directional coupler can correspond to Port (1,1) illustrated in FIG. 3. Moreover, as an example, in some configurations, Port 1 of the tandem directional coupler 100 can receive an RF signal. Port 2 (labeled in FIG. 12 as "PORT 2 (OUTPUT)") of the tandem directional coupler 100 can correspond to Port (1,2) of FIG. 3 and Port 3 can provide an output signal. Port 3 (labeled in FIG. 12 as "PORT 3 (INCIDENT PWR SAMPLE)") of the tandem directional coupler 100 can provide an incident power sample of the signal provided at Port 1 that can be monitored. Port 4 (labeled in FIG. 12 as "PORT 4 (REFLECTED PWR SAMPLE)") of the tandem directional coupler 100 can provide a reflected power sample of the signal reflected at Port 2.

Figure 13:
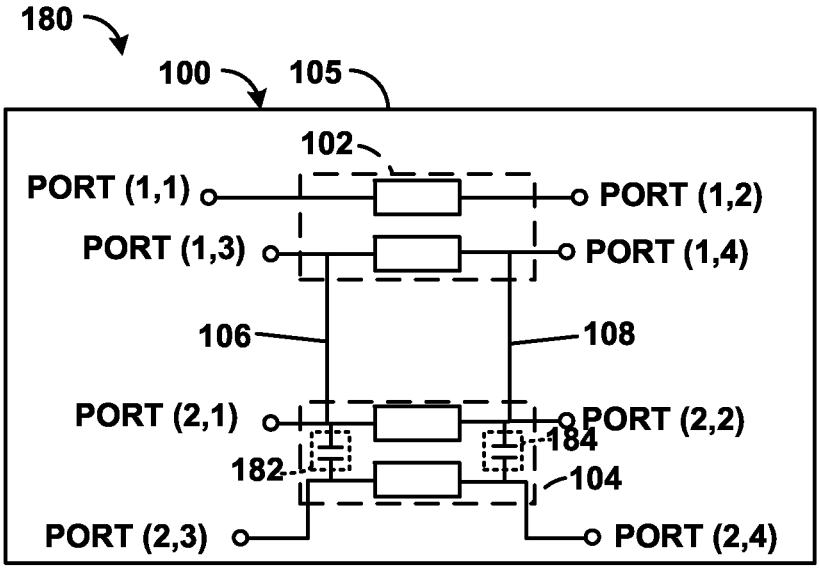
FIG. 13 illustrates the proposed tandem directional coupler illustrated in FIG. 3 that includes additional coupling capacitances.

Further improvement in directivity level can be achieved by introducing capacitive coupling at the ends of the traces of the second coupler in the tandem. FIG. 13 illustrates another example of a directional coupler system 180 that employs the directional coupler system 105 illustrated in FIG. 3. For purposes of simplification of explanation, the same reference numbers are employed in FIGS. 3 and 12 to denote the same structure. The directional coupler system 180 can include a first coupling capacitance 182 that capacitively couples Port (2,1) and Port (2,3) of the tandem directional coupler 100. Additionally, the directional coupler system 180 also includes a second coupling capacitance 184 that capacitively couples Port (2,2) and Port (2,4) of the tandem directional coupler 100. Each of the first coupling capacitance 182 and the second coupling capacitance 184 can be implemented, for example, as lump element capacitors. Inclusion of the first coupling capacitance 182 and the second coupling capacitance 184 can further improve the directivity, $D_{3,4}$ of the directional coupler system 180.

Figure 14:
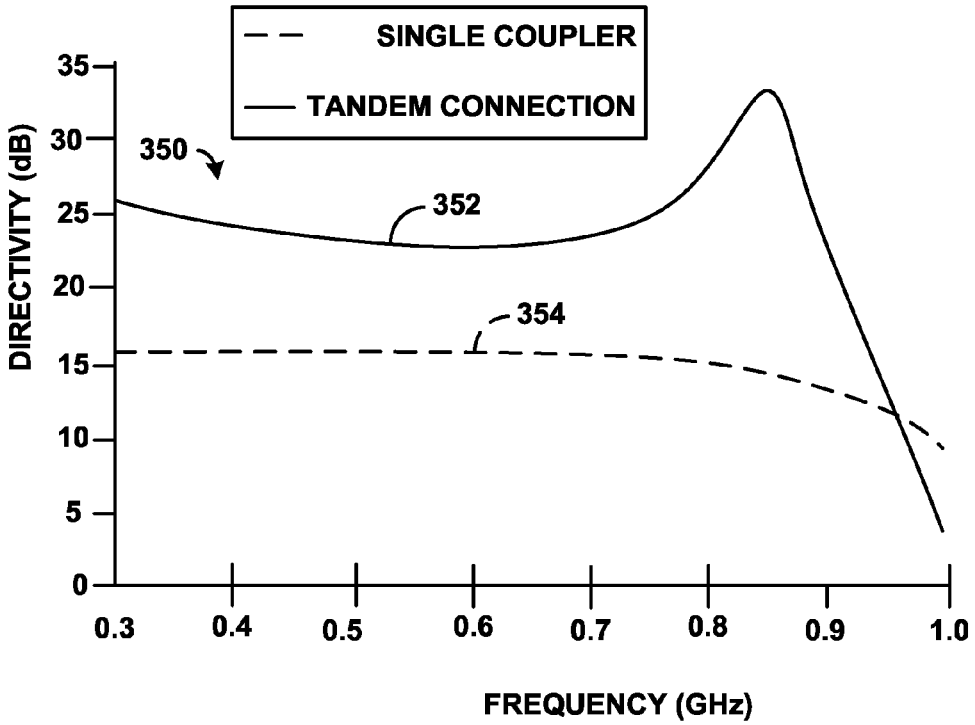
FIG. 14 illustrates an example of another graph that plots directivity as a function of frequency.

FIG. 14 illustrates an example of a graph 350 that plots directivity of a directional coupler (in dB) as a function of frequency (in GHz). The graph 350 includes a first plot 352 that plots the directivity, $D_{3,4}$, for the directional coupler system 180, with a tandem connection between the first directional coupler 102 and the second directional coupler 104 that each have a coupling coefficient of about −10 dB at center frequency (e.g., about 0.7 GHz) and where the first coupling capacitance 182 and the second coupling capacitance 184 have been included. The graph 350 also includes a second plot 354 that plots the directivity for a single, conventional directional coupler, such as the coupler 50 illustrated in FIG. 2 that also include a pair of coupling capacitances mounted thereon. As is illustrated by the graph 350, connecting two −10 dB directional couplers (e.g., the first directional coupler 102 and the second directional coupler 104) in a tandem connection will form a new directional coupler (e.g., the directional coupler system 180) with improved directivity.

Figure 15:
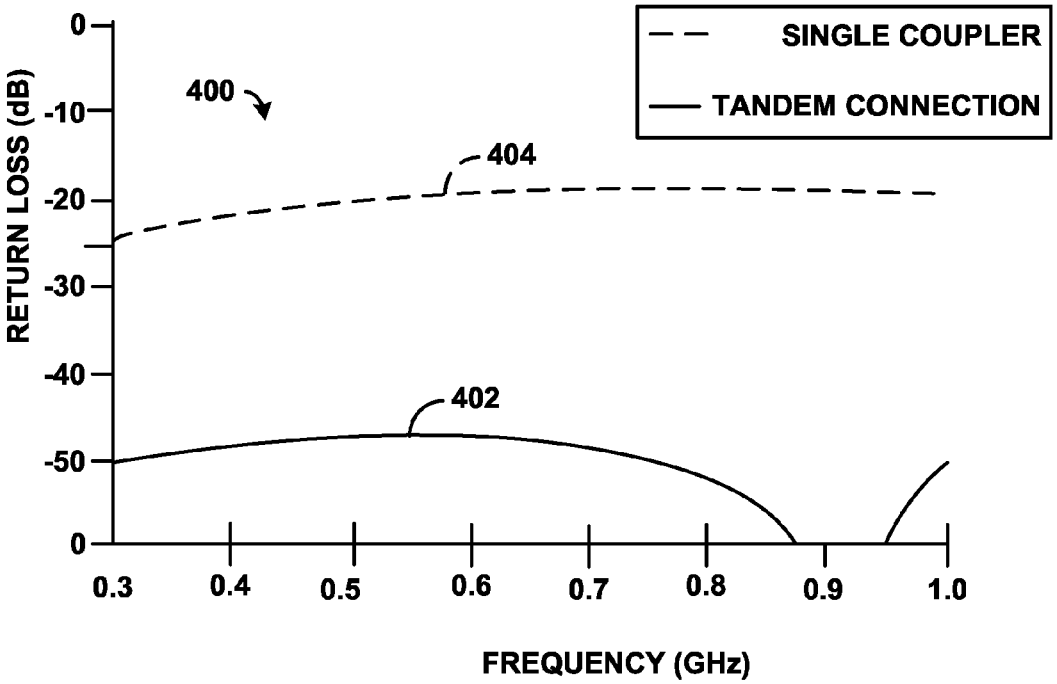
FIG. 15 illustrates an example of another graph that plots an input return loss as a function of frequency.

FIG. 15 illustrates an example of a graph 400 that plots an input return loss of a directional coupler (in dB) as a function of frequency (in GHz). The graph 400 includes a first plot 402 that plots a return loss, for the directional coupler system 180, with a tandem connection between the first directional coupler 102 and the second directional coupler 104 that each have a coupling coefficient of about −10 dB at a center frequency (e.g., about 0.7 GHz) and where the first coupling capacitance 182 and the second coupling capacitance 184 have been included. The graph 400 also includes a second plot 404 that plots the input return loss for a single, conventional directional coupler, such as the coupler 50 illustrated in FIG. 2, which also includes a pair of coupling capacitances mounted thereon. As is illustrated by the graph 400, connecting two −10 dB directional couplers (e.g., the first directional coupler 102 and the second directional coupler 104) in the tandem connection will form a new directional coupler (e.g., the tandem directional coupler 100) that allows for the introduction of capacitive compensation without adversely affecting the input return loss. In particular, as illustrated by the graph 400, the return loss of the directional coupler system 180 (the first plot 402) is improved relative to a single coupler (the second plot 404).

Where the disclosure or claims recite "a," "an," "a first," or "another" element, or the equivalent thereof, it should be interpreted to include one or more than one such element, neither requiring nor excluding two or more such elements. Furthermore, what have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims.

What is claimed is:

1. A circuit comprising:

a tandem directional coupler comprising a first directional coupler and a second directional coupler connected in tandem;

wherein a coupled port of the first directional coupler is connected to an input port of the second directional coupler and an isolated port of the first directional coupler is connected to a thru port of the second directional coupler;

a signal source coupled to an input port of the first directional coupler that provides an incident radio frequency (RF) signal; and a load coupled to a thru port of the first directional coupler that receives an output signal that corresponds to the incident RF signal;

wherein a coupled port and an isolated port of the second directional coupler are each coupled to respective input terminals of signal monitoring circuits, wherein each monitoring circuit has an input impedance that substantially matches a wave impedance of the tandem directional coupler.

2. The circuit of claim 1, wherein each of the first and second directional couplers are microstrip couplers with copper traces etched on a printed circuit board (PCB).

3. The circuit of claim 1, wherein the load is an antenna with an impedance of about 50 Ohms.

4. The circuit of claim 3, wherein the first directional coupler and the second directional coupler have sustainably the same coupling characteristics.

5. The circuit of claim 4, wherein coupled port of the second directional coupler is further coupled to a signal monitoring device that monitors a signal corresponding to the incident RF signal.

6. The circuit of claim 5, wherein:

$$S_{3,1} \sim \frac{c^2}{2-c^2};$$

wherein:

$S_{3,1}$ is a coupling coefficient between the input port of the second directional coupler and the coupled port of the first directional coupler at a center frequency; and c is a coupling coefficient of the first and second directional couplers at the center frequency.

7. The circuit of claim 4, wherein the isolated port of the second directional coupler is further coupled to a signal monitoring device that monitors a signal corresponding to a signal reflected from the load.

8. The circuit of claim 7, wherein:

$$S_{4,1} \sim \frac{2cI}{2-c^2};$$

wherein:

$S_{4,1}$ is an isolation parameter value for the tandem directional coupler at a center frequency;

c is a coupling coefficient of the first and second directional couplers at the center frequency; and I is the isolation coefficient of the first and second directional couplers.

9. The circuit of claim 4, wherein:

$$D_{3,4} = 20 \cdot \log\left(\frac{2I}{c}\right);$$

wherein:

$D_{3,4}$ is a directivity of the tandem coupler;

c is a coupling coefficient of the first and second directional couplers at a center frequency; and I is the isolation coefficient of the first and second directional couplers.

10. The circuit of claim 1, further comprising a plurality of coupling capacitances that couple the first strip of the second directional coupler with the second strip of the second directional coupler.

11. The tandem directional coupler of claim 1, wherein each of the first and second directional couplers has a coupling coefficient of $$c = \sqrt{\frac{S_{3,1}}{1 + S_{3,1}}},$$

wherein $S_{3,1}$ is a coupling coefficient between the input port of the first directional coupler and the coupled port of the second directional coupler at a center frequency of the tandem directional coupler.

12. A system for monitoring an incident signal comprising:

a tandem directional coupler comprising a first tightly coupled directional coupler and a second tightly coupled directional coupler connected in tandem;

wherein a coupled port of the first tightly coupled directional coupler is connected to an input port of the second tightly coupled directional coupler and an isolated port of the first tightly coupled directional coupler is connected to a thru port of the second tightly coupled directional coupler and the first and second ports of a microstrip of the second tightly coupled directional coupler are each connected to a terminating load with an impedance that substantially matches a wave impedance of the tandem coupler;

a signal source configured to provide an incident signal to an input port of the first tightly coupled directional coupler;

a load with a predefined impedance coupled to a thru port of the first tightly coupled directional coupler, the load being configured to receive the output signal that corresponds to the incident signal; and a signal monitoring device coupled to one of the coupled port of the second tightly coupled directional coupler and an isolated port of the second tightly coupled directional coupler, wherein the signal monitoring device is configured to monitor one of the incident signal and a reflected signal.

13. The system of claim 12, wherein each of the first and second tightly coupled directional couplers has a coupling coefficient of $$c = \sqrt{\frac{S_{3,1}}{1 + S_{3,1}}},$$

wherein $S_{3,1}$ is a coupling coefficient between the input port of the first directional coupler and a coupled port of the second directional coupler at a center frequency.

14. A tandem directional coupler:

a first directional microstrip line coupler comprising copper traces on a printed circuit board (PCB) comprising:

a first copper trace; and a second copper trace parallel to the first copper trace; and a second microstrip line directional coupler comprising copper traces on the PCB comprising:

a first copper trace; and a second copper trace parallel to the first copper trace;

wherein a coupled port of the first directional coupler is connected to an input port of the second directional coupler and an isolated port of the first directional coupler is connected to a thru port of the second directional coupler.

15. The tandem directional coupler of claim 14, wherein each of the first and second directional couplers has a coupling coefficient of $$c = \sqrt{\frac{S_{3,1}}{1 + S_{3,1}}},$$

wherein $S_{3,1}$ is a coupling coefficient between an input port of the first microstrip line directional coupler and a coupled port of the second microstrip line directional coupler at a center frequency of the tandem directional coupler.

16. The tandem directional coupler of claim 14, further comprising:

a signal source coupled to the input port of the first directional coupler that provides an input radio frequency (RF) signal; and a load coupled to the thru port of the second directional coupler that receives most of the input signal.

17. The tandem directional coupler of claim 14, wherein the first directional coupler and the second directional coupler have sustainably the same coupling characteristics.

* * * * *